US008632162B2

(12) United States Patent
Vaeth et al.

(10) Patent No.: US 8,632,162 B2
(45) Date of Patent: Jan. 21, 2014

(54) NOZZLE PLATE INCLUDING PERMANENTLY BONDED FLUID CHANNEL

(75) Inventors: Kathleen M. Vaeth, Penfield, NY (US); Hrishikesh V. Panchawagh, San Jose, CA (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/454,422

(22) Filed: Apr. 24, 2012

(65) Prior Publication Data

US 2013/0278677 A1 Oct. 24, 2013

(51) Int. Cl.
*B41J 2/14* (2006.01)

(52) U.S. Cl.
USPC ..... 347/47

(58) Field of Classification Search
USPC ..... 347/47
See application file for complete search history.

(56) References Cited

U.S. PATENT DOCUMENTS

| | | | |
|---|---|---|---|
| 4,636,808 | A | 1/1987 | Herron |
| 6,079,821 | A | 6/2000 | Chwalek et al. |
| 6,450,619 | B1 | 9/2002 | Anagnostopoulos et al. |
| 6,457,807 | B1 | 10/2002 | Hawkins et al. |
| 6,474,794 | B1 | 11/2002 | Anagnostopoulos et al. |
| 6,491,362 | B1 | 12/2002 | Jeanmaire |
| 6,505,921 | B2 | 1/2003 | Chwalek et al. |
| 6,554,410 | B2 | 4/2003 | Jeanmaire et al. |
| 6,575,566 | B1 | 6/2003 | Jeanmaire et al. |
| 6,588,888 | B2 | 7/2003 | Jeanmaire et al. |
| 6,793,328 | B2 | 9/2004 | Jeanmaire |
| 6,827,429 | B2 | 12/2004 | Jeanmaire et al. |
| 6,851,796 | B2 | 2/2005 | Jeanmaire et al. |
| 7,607,766 | B2 | 10/2009 | Steiner |
| 8,016,394 | B2 * | 9/2011 | Yamamoto ..... 347/71 |
| 2010/0271430 | A1 * | 10/2010 | Silverbrook et al. ..... 347/47 |

FOREIGN PATENT DOCUMENTS

EP 1 301 432 1/2007

OTHER PUBLICATIONS

R. Puligadda et al., "High-Performance Temporary Adhesives for Wafer Bonding Applications", Mater. Res. Soc. Symp. Proc., vol. 970, 2007 Materials Research Society.

S. Pargfrieder et al., "Temporary Bonding and DeBonding Enabling TSV Formation and 3D Integration for Ultra-thin Wafers", Electronics Packaging Technology Conference 2008, 2008 IEEE.

"Temporary Wafer Bonding for Advanced IC Packaging", 3M Wafer Support System, 3M 2009.

* cited by examiner

*Primary Examiner* — Lamson Nguyen
(74) *Attorney, Agent, or Firm* — William R. Zimmerli

(57) ABSTRACT

A printhead includes a nozzle membrane and a plurality of liquid chambers. Portions of the nozzle membrane define an array of nozzles. The nozzle array includes a length and each nozzle of the nozzle array includes an axis. Each of the plurality of liquid chambers is in fluid communication with a respective one of the nozzles of the nozzle array. Each of the plurality of liquid chambers includes a height dimension and a width dimension. The height dimension extends in a direction parallel to the axis of the respective nozzle. The width dimension extends in a direction along the length of the nozzle array. The height dimension and the width dimension have an aspect ratio of less than or equal to 9:1.

12 Claims, 9 Drawing Sheets

NOZZLE PLATE INCLUDING PERMANENTLY BONDED FLUID CHANNEL

CROSS REFERENCE TO RELATED APPLICATIONS

Reference is made to commonly-assigned, U.S. patent application Ser. No. 13/454,410, entitled "PERMANENTLY BONDED FLUID CHANNEL NOZZLE PLATE FABRICATION", filed concurrently herewith.

FIELD OF THE INVENTION

This invention relates generally to the field of digitally controlled printing systems and the manufacturing techniques associated with fabricating these systems, and in particular to printhead devices included in these printing systems and the manufacturing techniques associated with fabricating the printhead component of these systems.

BACKGROUND OF THE INVENTION

Ink jet printing has become recognized as a prominent contender in the digitally controlled, electronic printing arena because, e.g., of its non-impact, low-noise characteristics, its use of plain paper and its avoidance of toner transfer and fixing. Ink jet printing mechanisms can be categorized by technology as either drop on demand ink jet (DOD) or continuous ink jet (CIJ).

The first technology, "drop-on-demand" (DOD) ink jet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CIJ) printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous printing technology uses thermal stimulation of the liquid jet with a heater to form drops that eventually become print drops and non-print drops. Printing occurs by selectively deflecting one of the print drops and the non-print drops and catching the non-print drops. Various approaches for selectively deflecting drops have been developed including electrostatic deflection, air deflection, and thermal deflection.

Recently developed ink jet printing systems utilize drop forming devices associated with individual nozzles or groups of nozzles to control the formation of drops. For example, recently developed continuous ink jet printing systems utilize drop forming devices associated with individual nozzles or groups of nozzles to control breakup of the liquid streams flowing through nozzles into drops in response to the print data. U.S. Pat. No. 6,474,794, issued to Anagnostopoulos et al. on Nov. 5, 2002, and entitled INCORPORATION OF SILICON BRIDGES IN THE INK CHANNELS OF CMOS/MEMS INTEGRATED INK JET PRINT HEAD AND METHOD OF FORMING, describes a method for fabricating nozzle plates that can be used in these recently developed continuous inkjet systems. It involves forming integrated circuits for controlling the operation of the printhead on a silicon substrate, forming a thin membrane of insulating layers with nozzles and drop forming devices formed in the membrane, and forming a series of ink channels through the silicon substrate, the each of the ink channels being aligned with a nozzle. The silicon substrate includes ribs that separate the individual ink channels and provide strength to the nozzle plate.

While this nozzle plate construction is effective and extremely well suited for its intended application, there are difficulties associated with etching the individual ink channels through the silicon. High aspect ratio ink channels can be etched through the silicon substrate using a Deep Reactive Ion Etching (DRIE) process. However, the etch efficiency and straightness/quality of the sidewalls decreases with increasing feature aspect ratio, which can limit the device design and performance. As such, there is an ongoing need to improve nozzle plate performance and nozzle plate construction.

SUMMARY OF THE INVENTION

According to an aspect of the present invention, a printhead includes a nozzle membrane and a plurality of liquid chambers. Portions of the nozzle membrane define an array of nozzles. The nozzle array includes a length and each nozzle of the nozzle array includes an axis. Each of the plurality of liquid chambers is in fluid communication with a respective one of the nozzles of the nozzle array. Each of the plurality of liquid chambers includes a height dimension and a width dimension. The height dimension extends in a direction parallel to the axis of the respective nozzle. The width dimension extends in a direction along the length of the nozzle array. The height dimension and the width dimension have an aspect ratio of less than or equal to 9:1.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
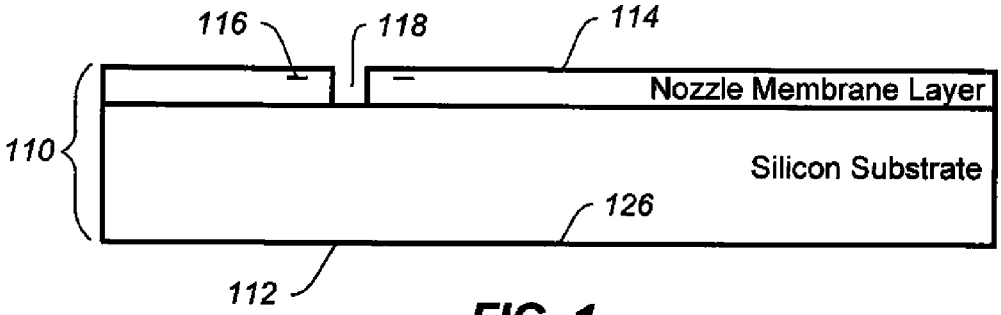
FIG. 1 shows a device wafer including a nozzle membrane on a silicon substrate.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. As such, as described herein, the terms "liquid," "ink," "print," and "printing" refer to any material that can be ejected by the printhead, the printing system, or the printing system components described below.

A process for making a nozzle plate structure, one or more of which is included in a printhead discussed in more detail below, is described with reference to FIGS. 1-8. Like the process outlined in U.S. Pat. No. 6,474,794, issued to Anagnostopoulos et al. on Nov. 5, 2002, the disclosure of which is incorporated herein in its entirety, the process set forth herein can begin with forming CMOS circuitry and the nozzle membrane structure 114 on a silicon substrate or wafer 112, as shown in FIG. 1. The nozzle membrane structure can include drop forming devices 116. The drop forming device can comprise resistive heating elements, piezoelectric devices, or electrode structures of electrohydrodynamic or dielectrophoresis stimulation devices, which are associated with one or more of the plurality of nozzles 118. As the process steps for doing this have been described in U.S. Pat. No. 6,474,794, which is incorporated herein by reference in its entirety, the process steps will not be separately described here. The silicon wafer with the one or more layers that form the nozzle membrane structure on the first surface is commonly called a device wafer 110.

Figure 2:
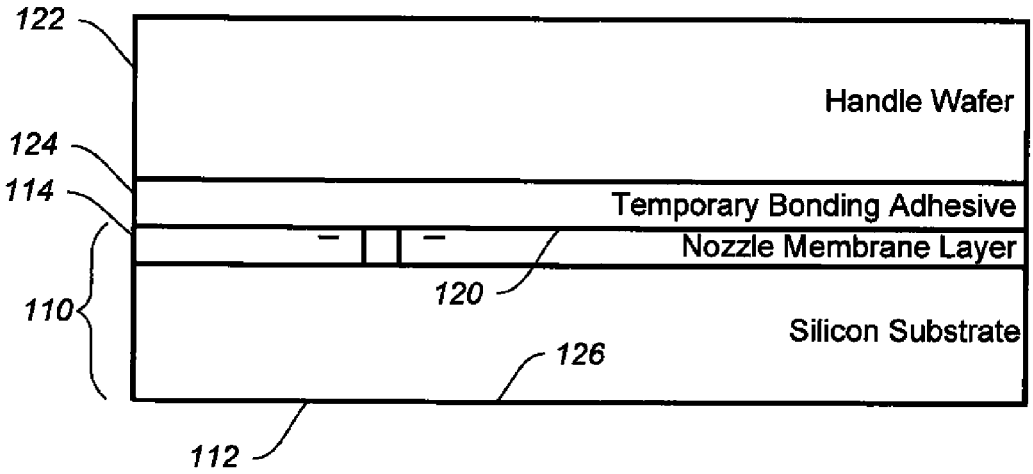
FIG. 2 shows a handling wafer attached to a first surface of the device wafer with a temporary adhesive.

A temporary handling, or carrier, wafer 122 is attached to the first surface 120 of the device wafer 110, as shown in FIG. 2. This surface of the wafer is referred to as the first surface of the wafer. Typically the handling wafer 122 is a silicon wafer so that its thermal expansion matches that of the device wafer, although glass (for example, quartz) or ceramic materials can also be used. The handling wafer 122 is attached to the device wafer 110 using a temporary adhesive material 124, for example, WaferBOND HT 10.10 from Brewer Science. It can be applied by solution deposition methods known in the art such as, but not limited to, spin coating and spray coating to either the handling wafer or the device wafer. A baking step is used to remove the solvents from the adhesive. Other adhesives are known in the art that can be applied by dry transfer or stamping and lamination. The handling wafer and the device wafer are then pressed together in a vacuum chamber at elevated temperature to bond them together. The WaferBOND HT material can be used with processing steps up to 300° C. The device wafer can be separated from the handling wafer by heating to about 200° C., which softens the thermoplastic material sufficiently to allow the two wafers to be slid apart. Another suitable temporary adhesive 124 is LC-3200, a UV curable adhesive from 3M. This adhesive can be applied by spin coating to the device wafer 110. After a release layer, for example, a 3M Light-to-Heat Conversion coating (not shown) is applied to the handling wafer 122, the handling wafer can be attached to the adhesive coated surface of the device wafer 110. The adhesive is then quickly cured, for example, using UV light. To separate the handling wafer from the device wafer, a laser is shown through the handling wafer to strike the release layer, which lowers the adhesion to the handling layer, allowing the handling layer to be removed. The adhesive layer is then removed from the device layer using, for example, 3M Wafer De-Taping Tape 3305, a process that leaves minimal residuals and creates little stress on the device wafer. Typically the handling wafer is from 500-1000 micron thick.

Figure 3:
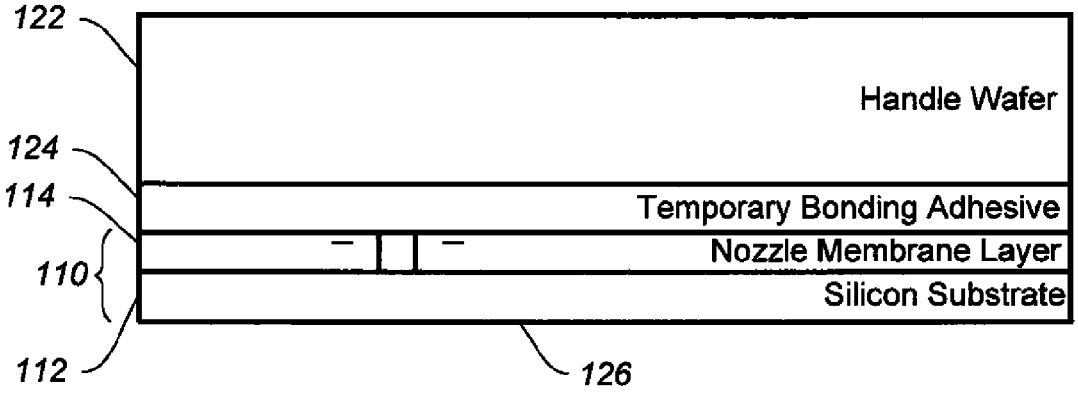
FIG. 3 shows the device wafer, and the handling wafer, after thinning of the device wafer.

With the device wafer 110 firmly bonded to the handling wafer 122, the back side of the device wafer can now be thinned. The back side of the device wafer is the side opposite the first surface that includes the membrane layer(s). The back surface of the device wafer is also called the second surface 126 of the device wafer. Processes for thinning the wafer are well known, and typically involve a grinding operation to quickly remove material, followed by polishing steps that can include one or more of the following: plasma etching, chemical etching, and chemical-mechanical planarization. The silicon substrate of the device wafer can be thinned to a final thickness ranging from 10 to 250 micron and more preferably to a final thickness ranging from 50 to 150 micron thick. The outcome is shown in FIG. 3.

Figure 4:
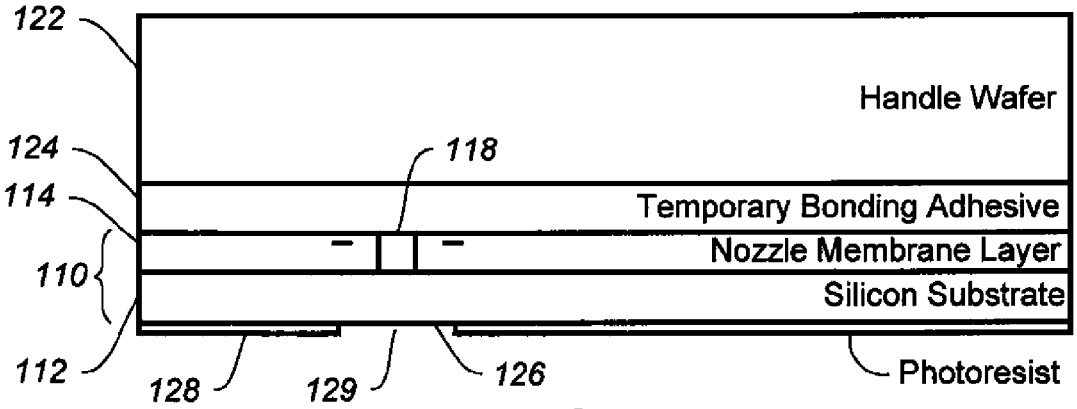
FIG. 4 shows the second surface of the device wafer patterned for etching.

Photoresist 128 is then applied to the second surface 126 of the device wafer, and it is masked to define the pattern 129 for the etching of the fluid channels in the silicon, as shown in FIG. 4. During the photomask process, the mask is aligned so that pattern 129 for the fluid channels to be etched in the silicon are aligned with the nozzles 118 formed in the membrane layer(s) on the first surface of the silicon substrate. This is typically done using IR front to back alignment tools that are standard in the industry (for example, the EVG 620 Automated Bond Alignment system) or by using a transparent carrier wafer such as glass.

Figure 5:
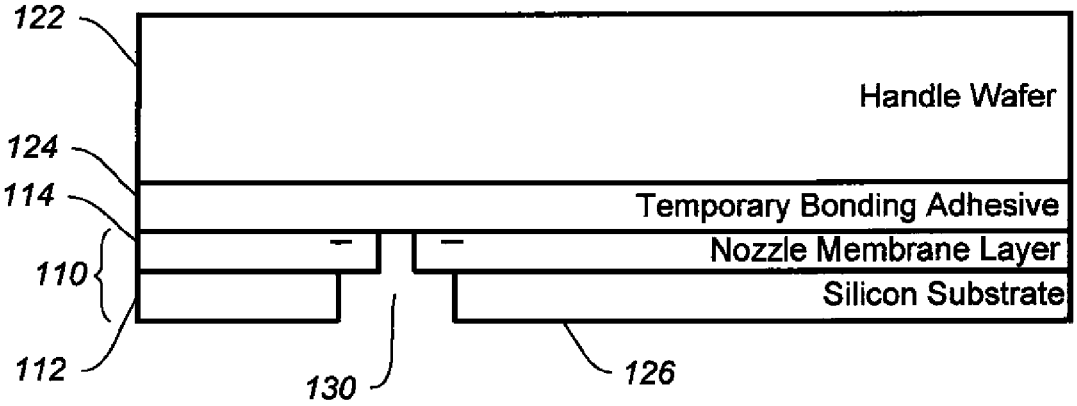
FIG. 5 shows the device wafer, and handling wafer, after etching the fluid channels in the silicon substrate.

Deep reactive ion etching (commonly referred to as DRIE) can then be used to etch the fluid channels 130 in the thinned silicon substrate 112. The reduced thickness of the silicon substrate, when compared to the original thickness of the silicon substrate, lowers the aspect ratio of the fluid channels to be etched. As a result of the lower aspect ratio of the fluid channels to be etched, the fluid channels 130 can be etched more quickly and with better sidewall quality, due to the improved efficiency of the etch, when compared to conventional systems and techniques. Following the DUE etching process, the photoresist is removed from the second surface 126 of the device wafer 110. The result is shown in FIG. 5.

A second wafer 132 is processed to form a permanent stiffening layer to the device wafer 110. The second wafer 132 can be a silicon wafer or be a wafer of another material that has appropriate materials properties such as thermal expansion to be compatible with the silicon device wafer for use in an inkjet printhead. The processing of the second wafer includes preforming one or more fluid channels 134 in the second wafer 132 such that the one or more fluid channels 134 of the second wafer 132 is in fluid communication with the plurality of fluid channels 130 of the silicon device wafer 110 after bonding. Photolithographic and etching processes are typically used to form the one or more fluid channels in the second wafer. These process steps, which are well known, are not separately shown. The one or more fluid channels in the second wafer are located in the second wafer so as to provide fluid communication with the fluid channels etched in the silicon substrate when the second wafer is bonded to the device wafer.

Figure 6:
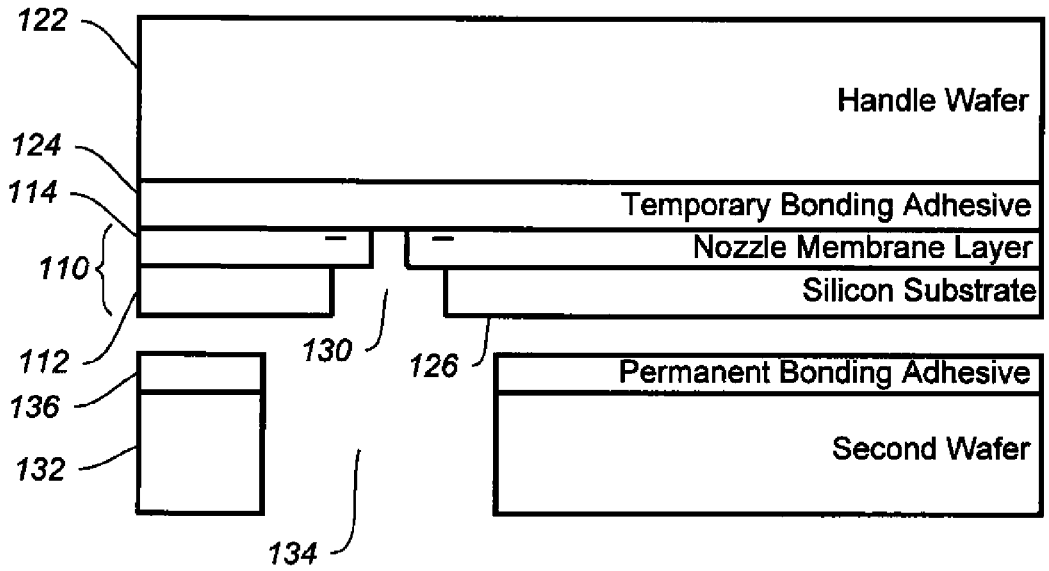
FIG. 6 shows a prepared second wafer aligned with the device wafer prior to bonding of the second wafer and the device wafer.
Figure 7:
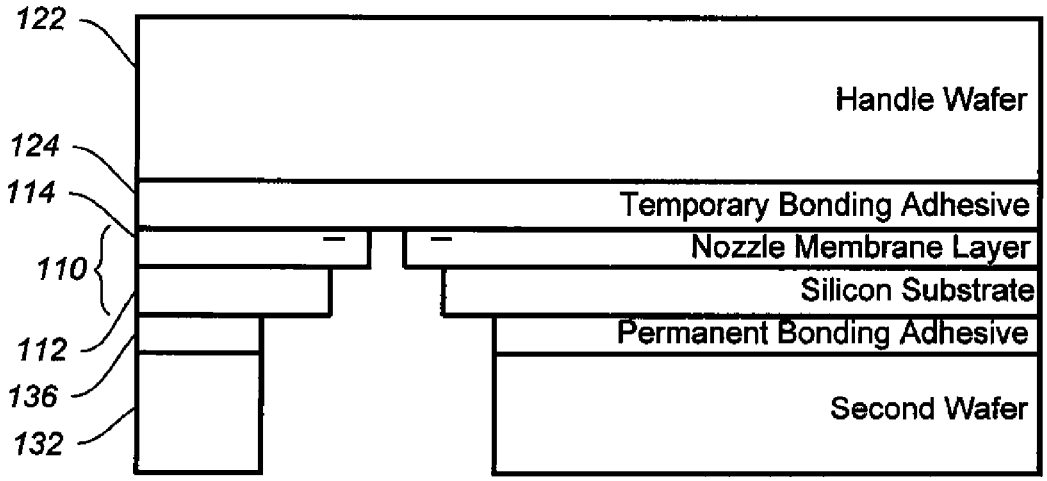
FIG. 7 shows the second wafer bonded to the device wafer.
Figure 8:
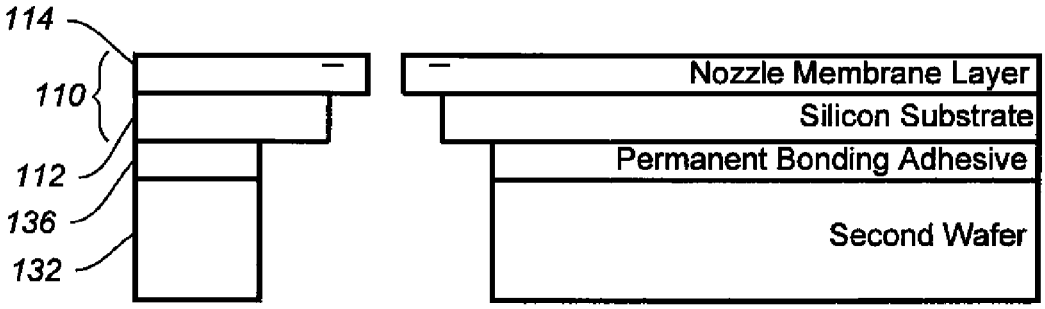
FIG. 8 shows the device wafer and the attached second wafer after removal of the handling wafer and the temporary adhesive.
Figure 9:
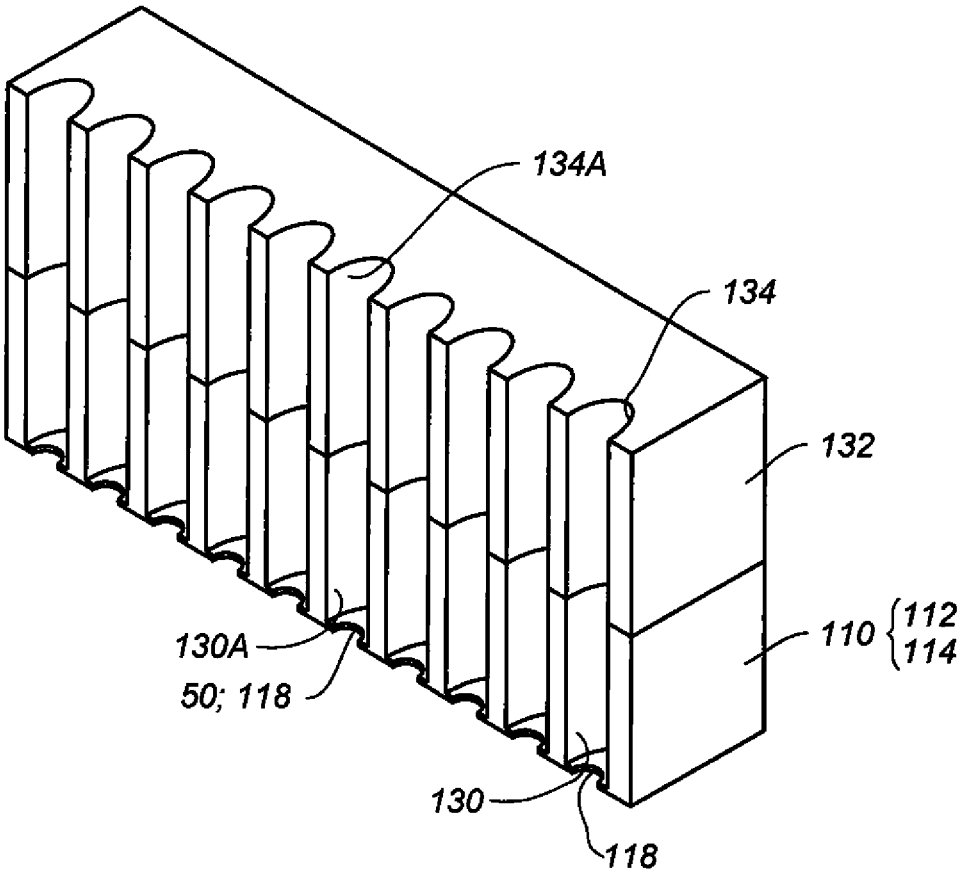
FIG. 9 shows a second wafer including a plurality of fluid channels in fluid communication with the plurality of fluid channels located in the device wafer.
Figure 10:
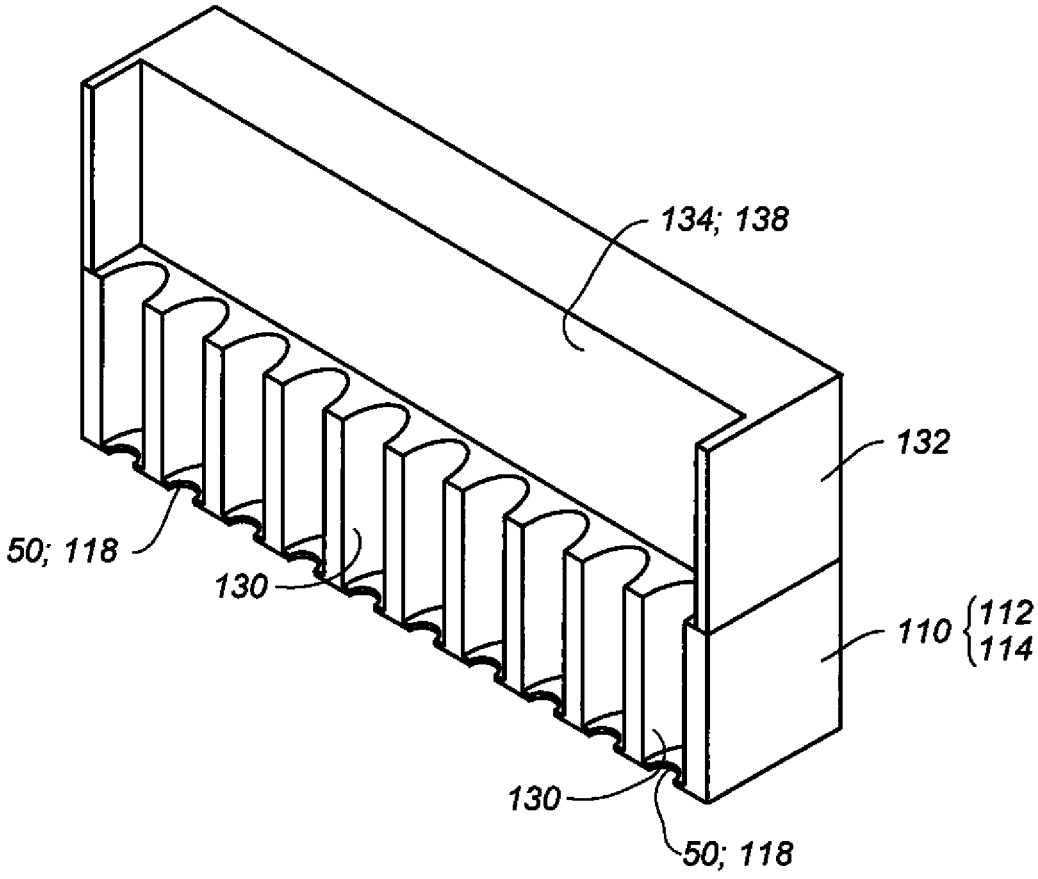
FIG. 10 shows a second wafer including an elongated trench in fluid communication with the plurality of fluid channels located in the device wafer.

Referring to FIG. 9, in some embodiments the fluid channels 134 of the second wafer are etched in a one to one correspondence with the fluid channels 130 of the device wafer 110. Referring to FIG. 10, in other embodiments the fluid channel 134 in the second wafer 132 is an elongated trench 138 etched through the second wafer. As shown in FIGS. 6-8, the elongated trench 138 or the plurality of fluid channels 134 extends into and out of the page. The length of the elongated trench 138 is sufficient to span the array of fluid channels etched in the device layer. The thickness of the second wafer typically ranges from 300-725 micron. In still other embodiments, one face of the second wafer includes an array of fluid channels in a one to one correspondence to the array of fluid channels of the device wafer. The array of fluid channels is located on the face of the second wafer such that they will align with the array of fluid channels of the device wafer once the device wafer and the second wafer are bonded together. The second face of the second wafer includes an elongated trench with the elongated trench being aligned with the array of fluid channels on the first face of the second wafer and etched to a depth sufficient to enable fluid communication between the elongated trench of the second face and the fluid channels of the array of fluid channels on the first face of the second wafer. The elongated trench includes a length sufficient to span the length of the array of fluid channels on the first side of the second wafer. The fluid channels on the first side of the second wafer and the fluid channel in the form of an elongated trench on the second face each are etched to sufficient depths to enable fluid communication between the elongated trench of the second face and the fluid channels of the array of fluid channels of the first face of the second wafer. In some of these embodiments, the second wafer can be an SOI wafer where the insulator layer serves as an etch stop to control the depth of the etching from each face of the wafer.

The preferred configuration of the fluid channel(s) in the second wafer depends on the application contemplated. The use of an array of fluid channels in a one to one correspondence with the fluid channels of the device wafer can provide enhanced functionality to the resultant printhead, for example, improved flow conditioning to the fluid supplied to the nozzles depending on the specific application contemplated, when compared to the use of an elongated trench form of fluid channel. Flow conditioning is discussed in more detail in U.S. Pat. No. 7,607,766, issued to Steiner on Oct. 27, 2009. The use of an array of fluid channels in a one to one correspondence to the array of fluid channels in the device wafer, however adds manufacturing complexity, in forming the fluid channels and aligning them with the channels of the device wafer, when compared to the use of an elongated trench form of fluid channel. For some applications the enhanced functionality warrants the added fabrication complexity, while in other applications the added fabrication complexity isn't justified.

A permanent adhesive layer 136 is applied to the bonding face of the second wafer 132 and the second wafer 132 is aligned with the device wafer 110 as shown in FIG. 6. The second wafer 132 is bonded to the device wafer 110 with the device wafer still being bonded to the handling wafer 122 as shown in FIG. 7. Suitable permanent bonding adhesives include SU8, benzocyclobutene (BCB), polyimide and parylene, each of which allows the wafers to be bonded together at temperatures that are safe for the CMOS circuitry. Methods known in the art for applying the adhesive to one or both of the wafer surfaces to be bonded include, but are not limited to, spin coating, spray coating, vapor deposition, dry transfer or stamping, and lamination. The SU8 and BCB materials are photosensitive, allowing photolithographic processes to be used to control the quantity of the adhesive used and the placement of the adhesive materials relative to the fluid channels. When bonding the second wafer to the device wafer, the second wafer should be aligned with the device wafer to ensure the fluid channels in the second wafer are appropriately aligned to the fluid channels in the device wafer. Wafer bonding equipment, with means for aligning the wafers, are available through vendors such as Suss MicroTec and EVG Group.

With the second surface 126 of the device wafer 110 securely bonded to the second wafer 132, the handling wafer 122 can be removed or debonded from the first surface 120 of the device wafer 110, as shown in FIG. 8. The method used for debonding the handling wafer from the device wafer depends on the temporary bonding process used, as was discussed above. The nozzle plate made up of the device wafer and the second wafer is then cleaned to remove any residues left from the temporary bond. The handling wafer is then available for reuse as a handling wafer for another device wafer.

In some applications, the process used for forming the thinned device wafer, temporarily bonding the device wafer to a handling wafer, grinding and polishing of the wafer to the desired thickness and then the etching the fluid channels, can be applied to the second wafer as well to form a thinned second wafer. Once the thinned second wafer is permanently bonded to the device wafer, the handling wafer of the second wafer is removed from the second wafer as is the handling wafer of the device wafer being removed from the device wafer.

In the present invention, the temporary bond and the permanent bond can be contrasted with each other. The temporary bond is provided by a suitable adhesive, referred to herein as a temporary adhesive. Typically, the temporary adhesive includes curing conditions that do not damage the structures on the device wafer, sufficient adhesive strength at the process conditions used for wafer thinning, sufficient adhesive strength during the etch process used to form the ink channels, sufficient adhesive strength during the permanent bonding process, and a mechanism to significantly reduce the adhesive strength in order to release the device wafer from the handle wafer without damaging the structures on the device wafer, or leaving any significant residue or contamination on the device wafer. The permanent bond is typically provided by a suitable adhesive, referred to herein as a permanent adhesive. Typically, the permanent adhesive provides acceptable, stable adhesive strength between the device wafer and second wafer during the de-bonding of the handling substrate, acceptable adhesive strength during the subsequent steps used for integration of the printhead into the printing system, and acceptable adhesive strength during the operation of the printhead in the printing system, and compatibility with the liquids used in the printhead.

In the fabrication process described above, alternatives are permitted. For example, nozzles 118 can be formed after the second substrate 132 is attached to the substrate 112 and the handling wafer 122 has been removed from substrate 112. Another example includes applying a protective coating on the nozzle membrane 114 prior to coating the nozzle membrane 114 with an adhesive and then affixing the handle substrate 122.

Figure 11:
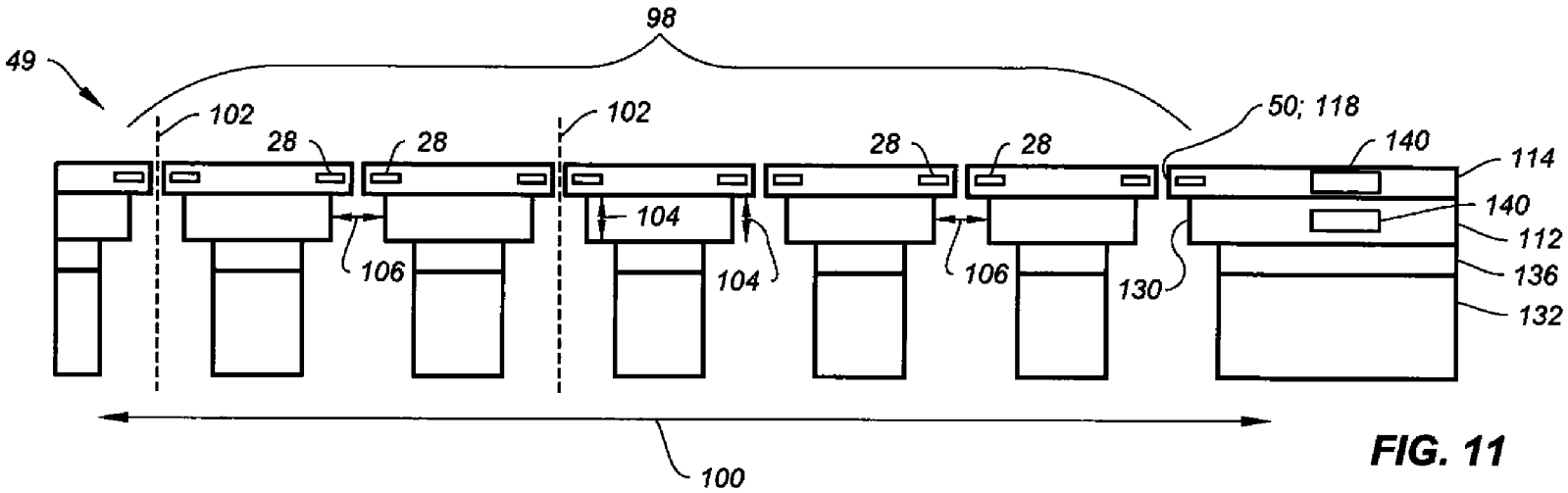
FIGS. 11 and 12 show partial schematic cross sectional views of a printhead made in accordance with the present invention.
Figure 12:
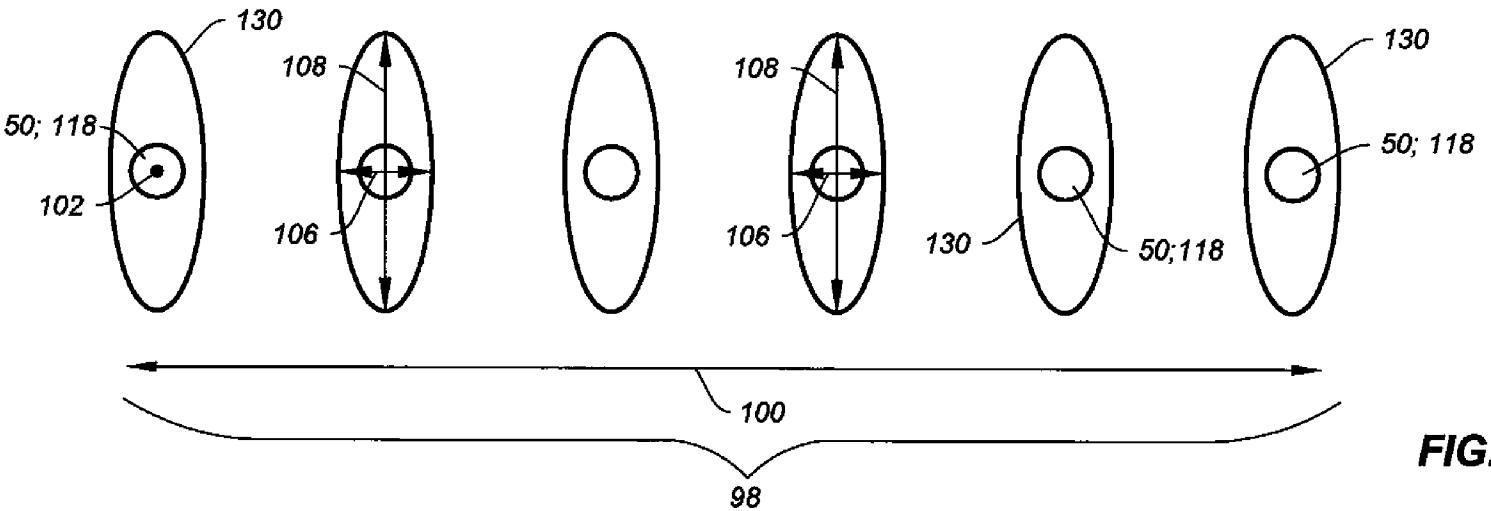

Referring to FIGS. 11 and 12 and back to FIG. 8, the device wafer 110 is divided into a plurality of nozzle plate structures 49, also commonly referred to as nozzle plates, one or more of which are included in a printhead 30. Typically, division of the device wafer 110 is accomplished using a conventional wafer dicing process.

The printhead 30 includes nozzle membrane 114 and a plurality of fluid channels 130, also commonly referred to as liquid chambers. Portions of the nozzle membrane 114 define a plurality, for example, an array 98, of nozzles 118. In the description presented below, reference sign 50 and reference sign 118 are used interchangeable to denote the nozzle 50, 118 of the printhead 30 of the present invention. The liquid chambers 130 are located in a first substrate 112. In some example embodiments, the plurality of liquid chambers 130 of printhead 30 is located in a silicon substrate. Other substrate materials, however, are permitted.

The nozzle membrane 114 includes a drop stimulation or drop forming device 28, described in more detail below. In some example embodiments of the invention, the drop forming device 28 includes a resistive heating element associated with one or more nozzles 50, 118 of the array 98 of nozzles 50, 118. In other example embodiments of the invention, the drop forming device 28 includes a piezoelectric device associated with one or more nozzles 50, 118 of the array 98 of nozzles 50, 118.

The nozzle array 98 includes a length 100 and each nozzle 50, 118 of the nozzle array 98 includes an axis 102. Each of the plurality of liquid chambers 130 is in fluid communication with a respective one of the nozzles 50, 118 of the nozzle array 98. Each of the plurality of liquid chambers 130 includes a height dimension 104 and a width dimension 106. The height dimension 104 extends in a direction parallel to the axis 102 of the respective nozzle 50, 118. The width dimension 106 extends in a direction along the length 100 of the nozzle array 98. In the present invention, the height dimension 104 and the width dimension 106 have an aspect ratio of less than or equal to 9:1. This aspect ratio is smaller when compared to aspect ratios of conventional nozzle plates.

The aspect ratio of the present invention controls the thickness of the wafer (and the substrate of the nozzle plate structure 49) resulting from the thinning of the wafer that includes the liquid chambers 130. The fluid channel aspect ratio is defined as the ratio of the wafer thickness to the shortest dimension of the fluid channel in the plane of the device wafer surface. In most cases, the shortest dimension is along the axis of the array of nozzles, but it is also possible in some designs for the shortest dimension of the fluid channel in the plate of the device wafer surface is perpendicular to the axis of the array of nozzles. In the present invention, the feature aspect ratio is less than 9:1, and more preferably less than 5:1.

As shown in FIG. 12, the liquid chambers 130 include an elliptical cross section when viewed in the direction parallel to the axis 102 of the nozzle 50, 118. The ellipse includes a short dimension and a long dimension. The width dimension 106 of the liquid chamber 130 is the short dimension of the ellipse. The long dimension of the ellipse is also referred to as the length dimension 108 of the liquid chamber 130. The elliptical cross sectional shape of liquid chamber 130 is oriented such that a line drawn through the center of the ellipse along the length dimension 108 of the ellipse is approximately perpendicular to the length 100 of the nozzle array 98. Additionally, the elliptical cross sectional shape of liquid chamber 130 is oriented such that a line drawn through the center of the ellipse along the width dimension 106 of the ellipse is approximately parallel to the length 100 of the nozzle array 98. This liquid chamber configuration allows for a high nozzle density along the row of nozzles while facilitating the nozzle plate structure 49 manufacturing process. The elliptical shape is one of a number of elongated, yet symmetrical, shapes for the liquid chamber 130. Other cross sectional shapes are permitted. For example, in other example embodiments of the invention, the cross sectional shape of the liquid can include a circle, a square, or a rectangle.

Referring additionally back to FIG. 9, as described above the plurality of liquid chambers 130 is located in a first substrate 112. In one example embodiment of the present invention, printhead 30 also includes a second substrate 132 that includes a segmented fluid channel 134. The second substrate 132 is permanently bonded to the first substrate 112. For a given segment, for example, 134A of the segmented fluid channel 134, the segment 134A is in fluid communication with one, for example, 130A, or a subset of the plurality of liquid chambers 130. CMOS circuitry 140 included in at least one of the nozzle membrane 114 and the first substrate 112. The permanent bond between the first substrate 112 and the second substrate 132 is provided by an adhesive that includes a curing temperature that is compatible with the CMOS circuitry 140.

Referring additionally back to FIG. 10, as described above the plurality of liquid chambers 130 is located in a first substrate 112. In another example embodiment of the present invention, printhead 30 also includes a second substrate 132 that includes a fluid channel 134. The second substrate 132 is permanently bonded to the first substrate 112. The fluid channel 134, commonly referred to as an elongated trench 138, is in fluid communication with the plurality of liquid chambers 130. CMOS circuitry 140 included in at least one of the nozzle membrane 114 and the first substrate 112. The permanent bond between the first substrate 112 and the second substrate 132 is provided by an adhesive that includes a curing temperature that is compatible with the CMOS circuitry 140.

Figure 13:
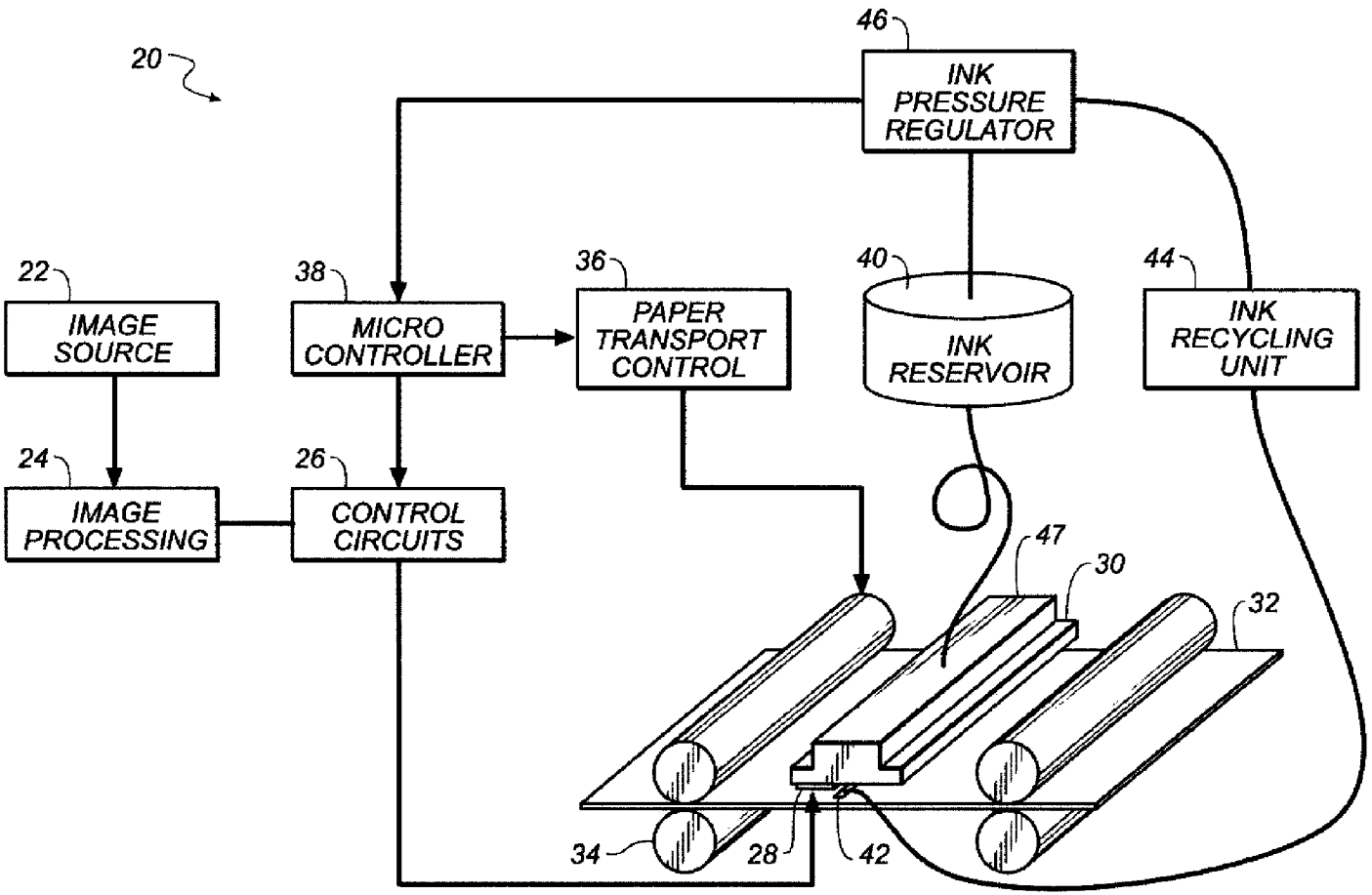
FIG. 13 (Prior Art)
FIG. 13 shows a simplified schematic block diagram of an example embodiment of a printing system made in accordance with the present invention.
Figure 14:
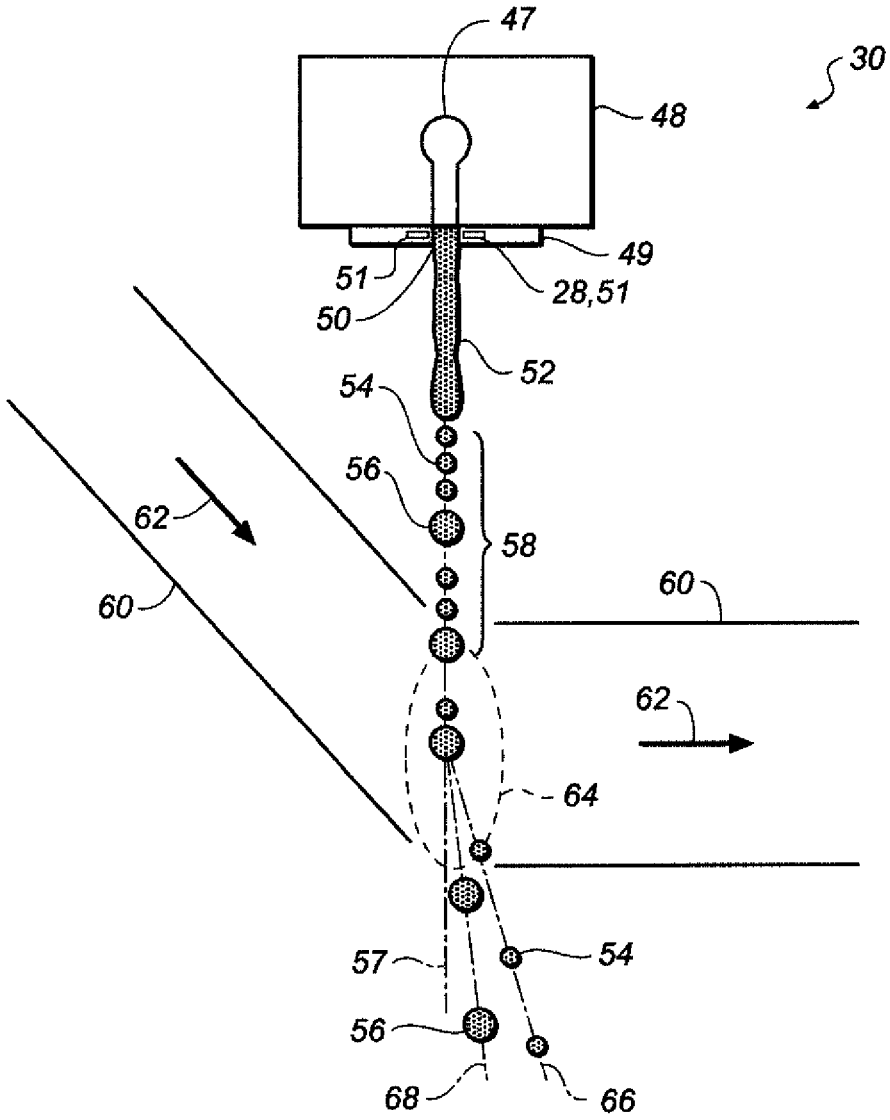
FIG. 14 (Prior Art)
FIG. 14 is a schematic view of an example embodiment of a continuous printhead made in accordance with the present invention.
Figure 15:
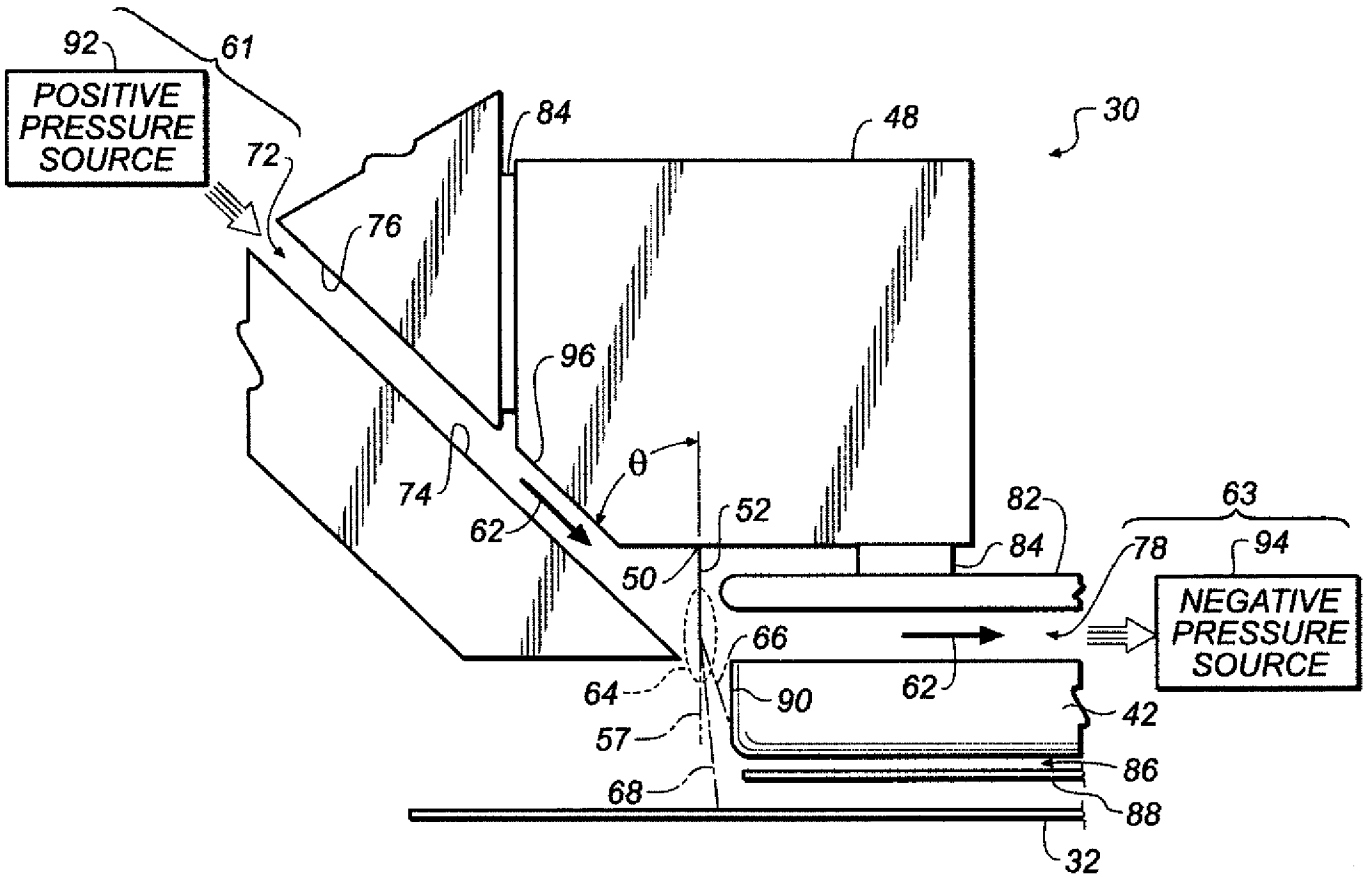
FIG. 15 (Prior Art)
FIG. 15 is a schematic view of an example embodiment of a continuous printhead made in accordance with the present invention.

Referring to FIGS. 13-15, example embodiments of a printing system and a continuous printhead are shown that include the invention described above. It is contemplated, however, that the present invention also finds application in other types of printheads or jetting modules including, for example, drop on demand printheads or other types of continuous printheads.

Referring to FIG. 13, a continuous printing system 20 includes an image source 22 such as a scanner or computer which provides raster image data, outline image data in the form of a page description language, or other forms of digital image data. This image data is converted to half-toned bitmap image data by an image processing unit 24 which also stores the image data in memory. A plurality of drop forming mechanism control circuits 26 read data from the image memory and apply time-varying electrical pulses to a drop forming mechanism(s) 28 that are associated with one or more nozzles of a printhead 30. These pulses are applied at an appropriate time, and to the appropriate nozzle, so that drops formed from a continuous ink jet stream will form spots on a recording medium 32 in the appropriate position designated by the data in the image memory.

Recording medium 32 is moved relative to printhead 30 by a recording medium transport system 34, which is electronically controlled by a recording medium transport control system 36, and which in turn is controlled by a micro-controller 38. The recording medium transport system shown in FIG. 13 is a schematic only, and many different mechanical configurations are possible. For example, a transfer roller could be used as recording medium transport system 34 to facilitate transfer of the ink drops to recording medium 32. Such transfer roller technology is well known in the art. In the case of page width printheads, it is most convenient to move recording medium 32 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 40 under pressure. In the non-printing state, continuous ink jet drop streams are unable to reach recording medium 32 due to an ink catcher 42 that blocks the stream and which may allow a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46. Alternatively, the ink reservoir can be left unpressurized, or even under a reduced pressure (vacuum), and a pump is employed to deliver ink from the ink reservoir under pressure to the printhead 30. When this is done, the ink pressure regulator 46 can include an ink pump control system. As shown in FIG. 13, catcher 42 is a type of catcher commonly referred to as a "knife edge" catcher.

The ink is distributed to printhead 30 through an ink channel 47. The ink preferably flows through slots or holes etched through a silicon substrate of printhead 30 to its front surface, where a plurality of nozzles and drop forming mechanisms, for example, heaters, are situated. When printhead 30 is fabricated from silicon, drop forming mechanism control circuits 26 can be integrated with the printhead. Printhead 30 also includes a deflection mechanism (not shown in FIG. 13) which is described in more detail below with reference to FIGS. 14 and 15.

Referring to FIG. 14, a schematic view of continuous liquid printhead 30 is shown. A jetting module 48 of printhead 30 includes an array or a plurality of nozzles 50 formed in a nozzle plate 49. In FIG. 14, nozzle plate 49 is affixed to jetting module 48. However, as shown in FIG. 15, nozzle plate 49 can be an integral portion of the jetting module 48.

Liquid, for example, ink, is emitted under pressure through each nozzle 50 of the array to form filaments of liquid 52. In FIG. 14, the array or plurality of nozzles extends into and out of the figure.

Jetting module 48 is operable to form liquid drops having a first size or volume and liquid drops having a second size or volume through each nozzle. To accomplish this, jetting module 48 includes a drop stimulation or drop forming device 28, for example, a heater or a piezoelectric actuator, that, when selectively activated, perturbs each filament of liquid 52, for example, ink, to induce portions of each filament to breakoff from the filament and coalesce to form drops 54, 56.

In FIG. 14, drop forming device 28 is a heater 51, for example, an asymmetric heater or a ring heater (either segmented or not segmented), located in a nozzle plate 49 on one or both sides of nozzle 50. This type of drop formation is known with certain aspects having been described in, for example, one or more of U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; U.S. Pat. No. 6,588,888 B2, issued to Jeanmaire et al., on Jul. 8, 2003; U.S. Pat. No. 6,793,328 B2, issued to Jeanmaire, on Sep. 21, 2004; U.S. Pat. No. 6,827,429 B2, issued to Jeanmaire et al., on Dec. 7, 2004; and U.S. Pat. No. 6,851,796 B2, issued to Jeanmaire et al., on Feb. 8, 2005.

Typically, one drop forming device 28 is associated with each nozzle 50 of the nozzle array. However, a drop forming device 28 can be associated with groups of nozzles 50 or all of nozzles 50 of the nozzle array.

When printhead 30 is in operation, drops 54, 56 are typically created in a plurality of sizes or volumes, for example, in the form of large drops 56, a first size or volume, and small drops 54, a second size or volume. The ratio of the mass of the large drops 56 to the mass of the small drops 54 is typically approximately an integer between 2 and 10. A drop stream 58 including drops 54, 56 follows a drop path or trajectory 57.

Printhead 30 also includes a gas flow deflection mechanism 60 that directs a flow of gas 62, for example, air, past a portion of the drop trajectory 57. This portion of the drop trajectory is called the deflection zone 64. As the flow of gas 62 interacts with drops 54, 56 in deflection zone 64 it alters the drop trajectories. As the drop trajectories pass out of the deflection zone 64 they are traveling at an angle, called a deflection angle, relative to the undeflected drop trajectory 57.

Small drops 54 are more affected by the flow of gas than are large drops 56 so that the small drop trajectory 66 diverges from the large drop trajectory 68. That is, the deflection angle for small drops 54 is larger than for large drops 56. The flow of gas 62 provides sufficient drop deflection and therefore sufficient divergence of the small and large drop trajectories so that catcher 42 (shown in FIGS. 13 and 15) can be positioned to intercept one of the small drop trajectory 66 and the large drop trajectory 68 so that drops following the trajectory are collected by catcher 42 while drops following the other trajectory bypass the catcher and impinge a recording medium 32 (shown in FIGS. 13 and 15).

When catcher 42 is positioned to intercept large drop trajectory 68, small drops 54 are deflected sufficiently to avoid contact with catcher 42 and strike the print media. As the small drops are printed, this is called small drop print mode. When catcher 42 is positioned to intercept small drop trajectory 66, large drops 56 are the drops that print. This is referred to as large drop print mode.

Referring to FIG. 15, jetting module 48 includes an array or a plurality of nozzles 50. Liquid, for example, ink, supplied through channel 47, is emitted under pressure through each nozzle 50 of the array to form filaments of liquid 52. In FIG. 15, the array or plurality of nozzles 50 extends into and out of the figure.

Drop stimulation or drop forming device 28 (shown in FIGS. 13 and 14) associated with jetting module 48 is selectively actuated to perturb the filament of liquid 52 to induce portions of the filament to break off from the filament to form drops. In this way, drops are selectively created in the form of large drops and small drops that travel toward a recording medium 32.

Positive pressure gas flow structure 61 of gas flow deflection mechanism 60 is located on a first side of drop trajectory 57. Positive pressure gas flow structure 61 includes first gas flow duct 72 that includes a lower wall 74 and an upper wall 76. Gas flow duct 72 directs gas flow 62 supplied from a positive pressure source 92 at downward angle θ of approximately a 45° relative to liquid filament 52 toward drop deflection zone 64 (also shown in FIG. 14). An optional seal(s) 84 provides an air seal between jetting module 48 and upper wall 76 of gas flow duct 72.

Upper wall 76 of gas flow duct 72 does not need to extend to drop deflection zone 64 (as shown in FIG. 14). In FIG. 15, upper wall 76 ends at a wall 96 of jetting module 48. Wall 96 of jetting module 48 serves as a portion of upper wall 76 ending at drop deflection zone 64.

Negative pressure gas flow structure 63 of gas flow deflection mechanism 60 is located on a second side of drop trajectory 57. Negative pressure gas flow structure includes a second gas flow duct 78 located between catcher 42 and an upper wall 82 that exhausts gas flow from deflection zone 64. Second duct 78 is connected to a negative pressure source 94 that is used to help remove gas flowing through second duct 78. An optional seal(s) 84 provides an air seal between jetting module 48 and upper wall 82.

As shown in FIG. 15, gas flow deflection mechanism 60 includes positive pressure source 92 and negative pressure source 94. However, depending on the specific application contemplated, gas flow deflection mechanism 60 can include only one of positive pressure source 92 and negative pressure source 94.

Gas supplied by first gas flow duct 72 is directed into the drop deflection zone 64, where it causes large drops 56 to follow large drop trajectory 68 and small drops 54 to follow small drop trajectory 66. As shown in FIG. 15, small drop trajectory 66 is intercepted by a front face 90 of catcher 42. Small drops 54 contact face 90 and flow down face 90 and into a liquid return duct 86 located or formed between catcher 42 and a plate 88. Collected liquid is either recycled and returned to ink reservoir 40 (shown in FIG. 13) for reuse or discarded. Large drops 56 bypass catcher 42 and travel on to recording medium 32. Alternatively, catcher 42 can be positioned to intercept large drop trajectory 68. Large drops 56 contact catcher 42 and flow into a liquid return duct located or formed in catcher 42. Collected liquid is either recycled for reuse or discarded. Small drops 54 bypass catcher 42 and travel on to recording medium 32.

Alternatively, deflection can be accomplished by applying heat asymmetrically to filament of liquid 52 using an asymmetric heater 51. When used in this capacity, asymmetric heater 51 typically operates as the drop forming mechanism in addition to the deflection mechanism. This type of drop formation and deflection is known having been described in, for example, U.S. Pat. No. 6,079,821, issued to Chwalek et al., on Jun. 27, 2000.

Deflection can also be accomplished using an electrostatic deflection mechanism. Typically, the electrostatic deflection mechanism either incorporates drop charging and drop deflection in a single electrode, like the one described in U.S. Pat. No. 4,636,808, or includes separate drop charging and drop deflection electrodes.

As shown in FIG. 15, catcher 42 is a type of catcher commonly referred to as a "Coanda" catcher. However, the "knife edge" catcher shown in FIG. 13 and the "Coanda" catcher shown in FIG. 15 are interchangeable and either can be used usually the selection depending on the application contemplated. Alternatively, catcher 42 can be of any suitable design including, but not limited to, a porous face catcher, a delimited edge catcher, or combinations of any of those described above.

The invention has been described in detail with particular reference to certain preferred embodiments thereof, but it will be understood that variations and modifications can be effected within the scope of the invention.

PARTS LIST

20 continuous printer system
22 image source
24 image processing unit
26 mechanism control circuits
28 drop stimulation device; drop forming device
30 printhead
32 recording medium
34 recording medium transport system
36 recording medium transport control system
38 micro-controller
40 reservoir
42 catcher
44 recycling unit
46 pressure regulator
47 channel
48 jetting module
49 nozzle plate; nozzle plate structure
50 plurality of nozzles
51 heater
52 liquid
54 drops
56 drops
57 trajectory
58 drop stream
60 gas flow deflection mechanism
61 positive pressure gas flow structure
62 gas flow
63 negative pressure gas flow structure
64 deflection zone
66 small drop trajectory
68 large drop trajectory
72 first gas flow duct
74 lower wall
76 upper wall
78 second gas flow duct
82 upper wall
86 liquid return duct
88 plate
90 front face
92 positive pressure source
94 negative pressure source
96 wall
98 nozzle array
100 nozzle array length
102 nozzle axis
104 liquid chamber height
106 liquid chamber width
108 liquid chamber length
110 device wafer
112 silicon substrate
114 nozzle membrane layer; nozzle membrane
116 drop forming device
118 nozzle
120 first surface
122 handle wafer
124 temporary adhesive
126 second surface
128 photoresist
129 pattern
130 fluid channel; liquid chamber
132 second wafer; second substrate
134 fluid channel

136 permanent adhesive
138 elongated trench
140 CMOS circuitry

The invention claimed is:

1. A printhead comprising:

a nozzle membrane, portions of the nozzle membrane defining an array of nozzles, the nozzle array including a length, each nozzle of the nozzle array including an axis; and a plurality of liquid chambers, each of the plurality of liquid chambers being in fluid communication with a respective one of the nozzles of the nozzle array, each of the plurality of liquid chambers including a height dimension and a width dimension, the height dimension extending in a direction parallel to the axis of the respective nozzle, the width dimension extending in a direction along the length of the nozzle array, the height dimension and the width dimension having an aspect ratio of less than or equal to 9:1.

2. The printhead of claim 1, the plurality of liquid chambers being located in a first substrate, further comprising:

a second substrate including a fluid channel, the second substrate being permanently bonded to the first substrate, the fluid channel being in fluid communication with and common to the plurality of liquid chambers.

3. The printhead of claim 2, further comprising:

CMOS circuitry included in at least one of the nozzle membrane and the first substrate.

4. The printhead of claim 3, wherein the permanent bond includes an adhesive that includes a curing temperature that is compatible with the CMOS circuitry.

5. The printhead of claim 1, the plurality of liquid chambers being located in a first substrate, further comprising:

a second substrate including a segmented fluid channel, the second substrate being permanently bonded to the first substrate, for a given segment of the segmented fluid channel, the segment being in fluid communication with one or a subset of the plurality of liquid chambers.

6. The printhead of claim 5, further comprising:

CMOS circuitry included in at least one of the nozzle membrane and the first substrate.

7. The printhead of claim 6, wherein the permanent bond includes an adhesive that includes a curing temperature that is compatible with the CMOS circuitry.

8. The printhead of claim 1, wherein the nozzle membrane includes a drop forming device.

9. The printhead of claim 8, wherein the drop forming device includes a resistive heating element associated with one or more nozzles of the array of nozzles.

10. The printhead of claim 8, wherein the drop forming device includes a piezoelectric device associated with one or more nozzles of the array of nozzles.

11. The printhead of claim 1, wherein the plurality of liquid chambers are located in a silicon substrate.

12. The printhead of claim 1, wherein the plurality of liquid chambers includes an elliptical cross section when viewed in the direction parallel to the axis of the respective nozzle, the ellipse including a short dimension and a long dimension, the width dimension being the short dimension of the ellipse.

* * * * *